United States Patent [19]

Husa

[11] 4,064,864

[45] Dec. 27, 1977

[54] HEATING APPARATUS

[76] Inventor: Marlin V. Husa, Liberty, Nebr. 68381

[21] Appl. No.: 731,186

[22] Filed: Oct. 12, 1976

[51] Int. Cl.[2] ..... F24B 7/04

[52] U.S. Cl. ..... 126/121; 126/143

[58] Field of Search ..... 126/120, 121, 164, 143

[56] References Cited

U.S. PATENT DOCUMENTS

| | | | |
|---|---|---|---|
| 1,371,390 | 3/1921 | Olds | 126/121 |
| 2,258,882 | 10/1941 | Craig | 126/121 |
| 2,277,381 | 3/1942 | Black | 126/121 |
| 3,096,754 | 7/1963 | Howrey | 126/120 |
| 3,942,509 | 3/1976 | Sasser | 126/164 |

FOREIGN PATENT DOCUMENTS

| | | | |
|---|---|---|---|
| 460,136 | 1/1937 | United Kingdom | 126/143 |

*Primary Examiner*—John J. Camby
*Assistant Examiner*—Larry I. Schwartz
*Attorney, Agent, or Firm*—Henderson, Strom & Sturm

[57] ABSTRACT

An apparatus for improving the heating characteristics of a fireplace for an enclosed area is disclosed. A heat exchange conduit extends concentrically through the chimney for a distance and then connects at one end to a ducting system having at least one outlet within the enclosed area. The other end of the conduit is connected with a plurality of bent arms which are positioned in the firebox and they, in turn, connect with a manifold pipe. The manifold pipe is a horizontal member having heat sensitive valves in the ends thereof, and orifices along the length thereof directed toward the firebox. A fan is positioned within the ducting to pull air primarily from the enclosed area and force it through the conduit.

7 Claims, 3 Drawing Figures

HEATING APPARATUS

BACKGROUND OF THE INVENTION

This invention relates generally to heating apparatus, and specifically to such apparatus which improve the operating characteristics of a fireplace.

The fireplace has for centuries been a primary source of home heating, and many developments have been made to improve the efficiency thereof. Advances in the overall design and selection of materials have vastly increased the amount of useful heat radiated into the work space. For example, U.S. Pat. No. 3,926,174 discloses a fireplace of sheet metal construction having a firebox with a rear wall of reverse curve design for radiating heat into the work space. Also, that patent discloses a hearth design having an air discharge opening connected to outside air for providing an inflow of air to the fireplace to satisfy draft requirements.

U.S. Pat. No. 3,802,415 discloses other improvements in fireplace design which regulate draft by controlling chimney throat configuration. Primarily, this patent teaches the use of a unique deflector which selectively controls the upward movement of hot gases and the downward movement of cold air.

BRIEF SUMMARY OF THE INVENTION

One of the objects of this invention is to provide a heating apparatus which improves the operating characteristics of a fireplace.

Another object of this invention is to provide a heating apparatus which is durable of construction, inexpensive of manufacture and extremely effective in use.

Another object of this invention is to provide a heating apparatus which employs hot flue gases to preheat air to be circulated within the work space.

Another object of this invention is to provide a heating apparatus which forces circulation of air from the work space through a heat transfer area and back into the work space.

Another object of this invention is to provide a heating apparatus which monitors temperature in the work space and if below a preset value, directs air onto the fire and thereby increases the heat output.

It is the further object of this invention to provide a heating apparatus which may selectively add fresh outside air to the space being heated.

It is a still further object of this invention to provide a heating apparatus which may double as a grate in a fireplace.

It is an even still further object of this invention to provide a heating apparatus which employs forced air in a heat transfer system to improve the operating characteristics of a fireplace.

The foregoing objects and others are accomplished in accordance with this invention by providing an apparatus for improving the heating characteristics of a fireplace for an enclosed area. A heat exchange conduit extends concentrically through the chimney for a distance and then connects at one end to a ducting system having at least one outlet within the enclosed area. The other end of the conduit is connected with a plurality of bent arms which are positioned in the firebox and they, in turn, connect with a manifold pipe. The manifold pipe is a horizontal member having heat sensitive valves in the ends thereof, and orifices along the length thereof directed toward the firebox. A fan is positioned within the ducting to pull air primarily from the enclosed area and force it through the conduit.

BRIEF DESCRIPTION OF THE DRAWINGS

For a better understanding of the invention as well as other objects and further features thereof, reference is made to the following detailed disclosure of the invention taken in conjunction with the accompanying drawings wherein.

DESCRIPTION OF THE PREFERRED EMBODIMENTS

Figure 1:
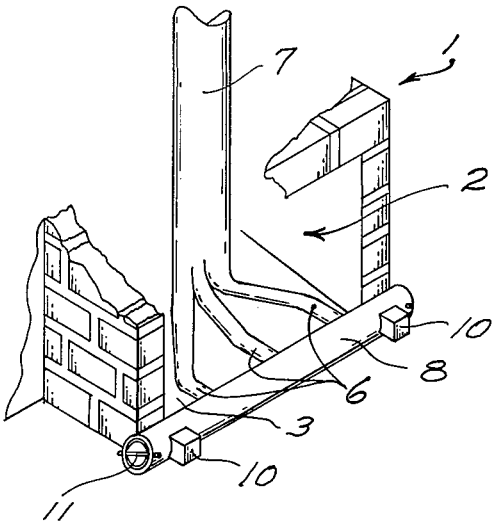
FIG. 1 is a partially schematic, cross-sectional view of a fireplace showing the bent arm members and the manifold pipe as they would be fitted within a fireplace.
Figure 3:
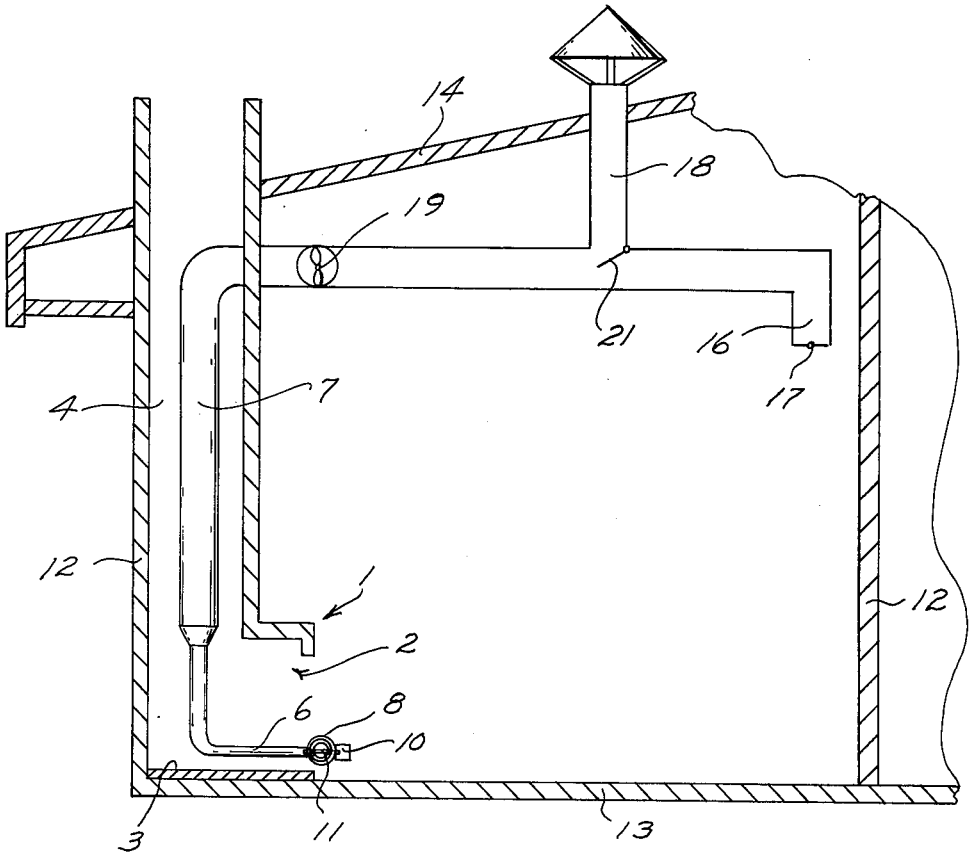
FIG. 3 is a partially schematic, partially cross-sectional view of a work space and fireplace showing the relative positioning of the elements of the heating apparatus of the instant invention.

The apparatus to be described below is an adaptation to most common fireplaces and is designed to augment the useful heat radiation characteristics thereof. The drawings, particularly FIGS. 1 and 3, show a fireplace 1 including a firebox 2 with hearth 3, and chimney 4. As previously indicated, the vast majority of heat produced in a fireplace is not put to practical use and escapes through the chimney in the form of hot gases; the instant invention reduces these losses.

FIG. 1 shows a prospective view of the elements of the instant invention which extract much of the normally wasted heat from the flue gases and direct it into the work space. A plurality of arms 6 have been bent through an arc of substantially 90° so that the opposing legs thereof, respectively, are directed up toward the chimney and out through the firebox opening. The legs of the arm members are all connected at one end to a conduit 7 which extends through the chimney opening. As will be explained below, air is forced through the conduit 7 and arm members 6 to pick up heat from the fire and flue gases. To this end, obviously the conduit 7 is desirably positioned within the chimney for maximum heat transfer. Conduit 7 should be spaced from the chimney walls so that contact with gases is maximized, and should extend within the chimney a distance as long as possible. The connection between arms 6 and conduit 7 can be made in any suitable manner such as by the use of a specially constructed manifold with interior surfaces designed to minimize air flow obstacles.

Figure 2:
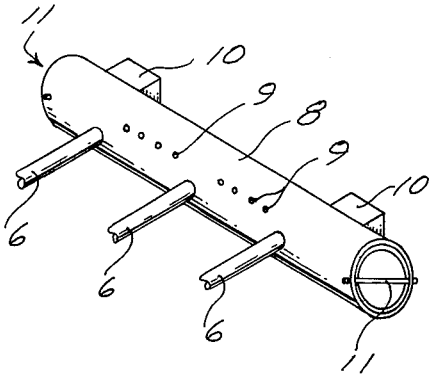
FIG. 2 is a perspective of the manifold pipe showing the connection thereof to the bent arm members.

As can best be seen in FIG. 2, the arms 6 are connected outside of the firebox 2 to a manifold pipe 8 which is positioned horizontally relative to the floor of the work space. The manifold pipe 8 is open-ended and includes a multiplicity of orifices 9 therein directed into the firebox area above the hearth 3 where the fire would be located. Positioned within the open ends of manifold pipe 8 are valve members 11 which may selectively restrict the opening over the range from full open to full closed. The valve may be either a manual damper type or, more preferably, an automatic valve which senses the temperature and closes as the temperature falls below a preset value. The drawings show an automatic valve control 10 which may take any suitable and well-known form such as, for example, a thermostatically controlled electric step motor attached internally (not shown) to the valve 11.

FIG. 3 shows a cross-section of the full system in position within an enclosed work space represented by walls 12, floor 13, and roof 14. The conduit 7 extends through chimney 4 and terminates within the work space at return vent 16 above and remote from the firebox 1. A manual closure 17 selectively restricts the flow of air into the conduit from the work space. Any suitable vent control device may be used for closure 17.

Air is moved through the system by a fan 19 located downstream from the return vent 16. The fan, of course, can be of any suitable size and configuration, and can be located anywhere within the circulation system. Preferably, fan 19 has in-line location and is of the rotating blade type. Alternatively, the fan can be eliminated if an external conduit is affixed to direct outside wind through the conduit in the desired direction. Such an arrangement would not be as effective as the fan, but would nonetheless be useful in locations without electricity.

In addition to the air vent 16, the system includes an auxilliary inlet 18 which, through the action of valve 21, may pull air from the outside into the circulation system. Valve 21 may be either manual or automatic humidity controlled, and regulates the relative amounts of air flow through vent 16 and inlet 18. The fan 19, or other air moving means, should obviously also be downstream of inlet 18.

In operation, a fire is built in the firebox 2 either on or above arms 6 and the heated gases flow up and out of chimney 4. For purposes of explanation, assume that the work space is cool, but warmer than the outside. Under these conditions, return vent 16 would be closed by valve 21 and inlet 18 opened, thus allowing the work space to maintain its warmer temperature. The fan 19 is then turned on to force air through inlet 18, conduit 7 and arms 6. The valves 11 in the manifold pipe 8 are substantially closed because of the cool temperature sensed. The air entering the manifold pipe cannot escape through the ends of the pipe and is forced through orifices 9 onto the burning fire. The fire then becomes more intense because of the addition of oxygen.

After the fire is burning well, the inlet 18 is closed and the return vent 16 opened by valve 21. The valves 11 in manifold 8 open to circulate heated air, heated within conduit 7 and arms 6, out the ends thereof into the lower part of the work area. Vent control 17 must also be adjusted to maintain desired circulation. If, for any reason the fire begins to put out less heat, the room temperature will drop and the valves 11 will again restrict air flow into the room and force it onto the fire through orifices 9 to increase heat output.

It should be noted that the materials of which the elements are constructed should be selected with durability under high temperatures and heat transfer characteristics in mind. Conduit 7 and arms 6 are preferably round in cross-section to maximize surface area, but may be of any other suitable cross-section.

It will be understood that various changes in the details, materials, steps and arrangements of parts which have been described and illustrated in order to explain the nature of the invention, will occur to, and may be made by those skilled in the art upon a reading of the disclosure within the principles and scope of the invention.

For example, the heating apparatus has been shown to have only one return vent, but it is well within the scope of this invention to have several such vents in one or more rooms. The term "work space" means only a volume to be heated and is not meant to exclude multiple rooms in a structure.

Also, the number of arms 6 is shown to be three in the drawings; however, any number may be employed depending upon cross-sectional size of individual arms and firebox dimensions. Likewise, the number of orifices 9 is not a critical feature, so long as the total amount of air directed through them is sufficient to add substantial amounts of oxygen to increase the fire heat output.

Furthermore, for example, the chimney shown is substantially straight, but this need not be the case. The conduit 7 may follow any chimney configuration and may include a chimney damper therearound.

The arms 6 may further include legs for supporting the structure above the hearth. Certainly, this would be an advantage when large amounts of combustible material are stacked in the firebox.

Further, it should be readily apparent that the actuating temperature for the automatic control 10 will depend entirely upon location of the sensor and desired temperature conditions.

I claim:

1. Apparatus for heating an enclosed area having a firebox open on one side toward the area to be heated and a chimney in fluid communication with the firebox on one end and the atmosphere outside the enclosed area on the other end, said apparatus comprising:

a. a plurality of tubular arm members, said arm members each having a first end and a second end with a directional change thus forming a curve therebetween, said first ends of said arm members adapted to project through the open side of the firebox and said second ends of said arm members adapted to project toward the chimney b. an elongate conduit having first and second ends, said first end of said conduit fixed to and in fluid communication with said second ends of said arm members, said conduit adapted to extend at least partially along and within the chimney and terminating at said second end of said conduit within the enclosed area;

c. an air moving means in fluid flow communication with said conduit intermediate said first and second ends thereof for moving air from said conduit second end through said elongate conduit; and d. an open-ended elongate tubular chamber affixed to and in sealed fluid communication with said first ends of said arm members, said chamber having a multiplicity of orifices along the length thereof directed toward said curved portions of said arm members, the open ends of said chamber being located outside of the firebox; and e. a valve in each of the open ends of said chamber.

2. The apparatus of claim 1 wherein said valves in the open ends of said chamber are temperature controlled and gradually close said openings as the temperature falls below a pre-set value and gradually open said openings as the temperature rises.

3. The apparatus of claim 2 wherein said conduit further includes a first closure means affixed thereto at second end thereof.

4. The apparatus of claim 3 further including:

a. an air duct having a first end affixed to and in fluid communication with said conduit intermediate said air moving means and said second end of said conduit, and a second end in fluid communication with the atmosphere outside the enclosed area; and b. a second closure means within said conduit positioned to selectively close either said air duct or said conduit beyond the juncture of said duct and said conduit.

5. The apparatus of claim 4 wherein said air moving means comprises an in-line fan positioned within said conduit.

6. The apparatus of claim 5 wherein said arm members, conduit and tubular chamber are all substantially circular in cross-sectional configuration.

7. The apparatus of claim 6 wherein said tubular chamber comprises an elongate substantially straight pipe extending substantially perpendicularly to the longitudinal axis of that portion of said conduit adapted to extend through the chimney.

* * * * *